US005788076A

United States Patent [19]

Simmons

[11] Patent Number: 5,788,076

[45] Date of Patent: Aug. 4, 1998

[54] PACKAGE WRAPPER BEARING INFORMATION

[76] Inventor: Deborah Jane Simmons, 65 College Cross, Islington, London, NI 1PT, United Kingdom

[21] Appl. No.: 591,526

[22] PCT Filed: Aug. 1, 1994

[86] PCT No.: PCT/GB94/01670

§ 371 Date: Feb. 2, 1996

§ 102(e) Date: Feb. 2, 1996

[87] PCT Pub. No.: WO95/03978

PCT Pub. Date: Feb. 9, 1995

[30] Foreign Application Priority Data

Aug. 2, 1993 [GB] United Kingdom ..... 9315993
Jun. 27, 1994 [GB] United Kingdom ..... 9412849

[51] Int. Cl.[6] ..... B65D 85/00; B65D 65/38; G09F 3/00

[52] U.S. Cl. ..... 206/459.5; 40/306; 40/310; 40/312; 206/497; 229/87.01; 229/87.06; 229/87.18; 229/89

[58] Field of Search ..... 40/306, 310, 312; 206/459.5, 497; 229/87.01, 87.05, 87.06, 87.13, 87.18, 89

[56] References Cited

U.S. PATENT DOCUMENTS

| | | | |
|---|---|---|---|
| 14,000 | 10/1855 | Cole | 40/306 |
| 1,686,354 | 10/1928 | Wallace . | |
| 1,939,794 | 12/1933 | Seybold et al. | 229/87.05 |
| 1,951,019 | 3/1934 | Hoffman et al. | 229/89 |
| 1,965,353 | 7/1934 | Nones | 229/89 |
| 2,385,257 | 9/1945 | Canallito | 206/497 X |
| 2,422,314 | 6/1947 | Rheinstrom | 229/89 |
| 2,647,334 | 8/1953 | Wilsher et al. | 229/87.05 X |
| 3,355,303 | 11/1967 | Meyers | 206/497 X |
| 3,927,484 | 12/1975 | Spiegel et al. . | |
| 4,224,416 | 9/1980 | Taylor et al. | 206/497 X |
| 4,268,567 | 5/1981 | Harmony . | |
| 4,323,608 | 4/1982 | Denny et al. | 40/310 X |
| 4,546,881 | 10/1985 | Tasma | 206/459.5 |
| 5,207,746 | 5/1993 | Jones | 40/310 X |
| 5,209,367 | 5/1993 | Van Musscher et al. . | |

OTHER PUBLICATIONS

Modern Packaging, "A Breakthrough at Boraxo," Feb. 1995, pp. 103–105.

*Primary Examiner*—Bryon P. Gehman
*Attorney, Agent, or Firm*—George R. Schultz; Strasburger & Price LLP

[57] ABSTRACT

A package comprising a container having regular information on an outer surface thereof and a wrapper extending at least partially over the container surface and bearing information of which at least some is substantially identical to at least some of the regular information on the outer container surface.

32 Claims, 2 Drawing Sheets

PACKAGE WRAPPER BEARING INFORMATION

TECHNICAL FIELD OF THE INVENTION

This invention relates to a package and is especially, but not exclusively, related to a retail package for point-of-sale display purposes comprising a can, bottle or other container bearing information which is printed on an outer surface thereof and which relates to, inter alia, the contents thereof. Such information usually includes descriptive matter relating to the contents of the can, bottle or other container, decorative matter, a bar code, a trade mark, a sell-by-date and/or other matter relevant to the particular product; such information forms part of the standard "get-up" of the package and will be referred to as "regular information" hereinafter.

BACKGROUND OF THE INVENTION

Known retail cans of, say, beverages, for instance, carbonated drinks, such as cola drinks and the like, are generally made of a metallic material, for example, steel or an aluminium alloy, and are printed with regular information on their outer cylindrical surfaces. The provision of information in addition to the regular information already printed on the cans for, say, a comparatively short period of time for limited period promotional purposes, can be somewhat difficult and expensive to achieve, in that additional facilities for printing such additional information have to be provided on a short term basis. This results in additional expense in producing the printed can, and, as a result, potentially higher retail costs.

SUMMARY OF THE INVENTION

It is an object of the present invention to provide a package which is more flexible and overcomes, or at least substantially reduces, the above-described disadvantage associated with existing beverage cans and other types of product-filled containers.

Accordingly, the invention provides a package comprising a container (2) having regular information on an outer surface (4) thereof and a wrapper (3) extending at least partially over said outer container surface (4) and bearing information; characterized in that the package (1) is a promotional package and at least some of the information borne by the wrapper (3) is substantially identical to at least some of the regular information on the outer container surface (4).

By "promotional package" is meant a sale or display "get-up" which differs from the standard "get-up", in some way in order to enhance or boost the marketability of the associated product. Thus, over a comparatively short period of time for limited period promotional purposes, the sale or display "getup" of the promotional package of this invention may differ from the standard "get-up" by, for example, including on the wrapper (in addition to its replication of at least some of the regular information on the outer container surface) further or promotional information which differs in style or content from any of the regular information and which, thus, will draw attention to the special promotional nature of the package.

The outer surface of the wrapper may be provided with such information and/or the inner surface of the wrapper may be so-provided, in which latter case, the wrapper may be transparent or semi-opaque, so that the information on the inner surface of the wrapper can be viewed therethrough.

Preferably, the regular information extends over substantially the whole of an outer surface of the container, in which case the information which is substantially identical to at least some of that regular information and which is borne by the wrapper, may also extend substantially wholly thereover.

Preferably, substantially all the information borne by the wrapper is substantially identical to the regular information on the corresponding outer surface of the container.

The container may be in any suitable form, for example, a metallic, plastics or glass can bottle, cup or beaker, or a box made of cardboard or the like, whose outer surface is printed with regular information relating to the contents thereof.

The wrapper is preferably attached to the container, optionally in intimate contact therewith, such that it extends over substantially the whole of the regular information on outer surface thereof. Preferably also, the wrapper is made of a synthetic plastics material which may be heat-shrunk on to the corresponding outer surface of the container and its inner surface may be provided with further information, for example, relating to a promotion of the product involved. Alternatively, any synthetic plastics wrapper may be adhered or otherwise attached to the corresponding surface of the container.

Also, and as a further alternative, the wrapper may be of paper which can be adhered to the corresponding outer surface of the container or otherwise suitably attached thereto.

The wrapper preferably extends over the outer container surface in a continuous manner without any overlapping portions, to provide a generally smooth outer surface for the package. However, in other circumstances, particularly if the wrapper extends only partially over the outer container surface, there may be a slight ridge between the wrapper edges and that container surface. Further, if there is an overlap of portions of the wrapper, then there may also be a slight ridge between the free edge of the overlapping wrapper portion and the main portion of the wrapper in contact with the outer container surface.

Although the wrapper is provided with information of which at least some is substantially identical to at least some of the regular information provided on the corresponding outer surface of the container, it may also be provided on its outer and/or inner surface with further information relating to, say, a promotion of the product in question.

Additionally or alternatively, such further information and/or additional information may be included on a carrier, such as, a printed sheet, sandwiched between the outer surface of the container and the wrapper, of which at least part can be used as a prize, token or redeemable voucher.

Also, the wrapper may be removable from the container by means of an integral tear strip preferably extending at least partially between opposed edges thereof, such as the top and bottom thereof. However, other means for enabling or assisting in the removal of the wrapper may be employed.

At least part of the wrapper may be used as a prize, token and/or redeemable voucher in respect of any promotion involved.

Because the wrapper extends at least partially, and preferably substantially wholly, over the outer surface of the container on which the regular information is provided and has, preferably, on its outer surface, information of which at least some is substantially identical to at least some of the regular information on the outer surface of the container, the presence of the wrapper is not immediately evident. This is particularly the case when the wrapper extends over substantially the whole of the corresponding outer container surface and bears information which is a substantial replica of the regular information on that outer container surface.

Advantageously, the outer container surface on which the regular information is provided, constitutes the side wall of the container which may be in the form of a can, bottle, cup, beaker or box or any other form of container.

The container and wrapper are preferably preformed as separate components, with the wrapper being applied subsequently to the container, although in certain circumstances the wrapper and container may be formed together as a unitary package.

In order that the invention may be more fully understood, a retail promotional package in accordance therewith will now be described by way of example and with reference to the accompanying drawing which is an elevational view of the package with part of a wrapper removed to reveal part of the corresponding outer printed surface of an associated container.

DETAILED DESCRIPTION OF THE DRAWINGS

Figure 1:
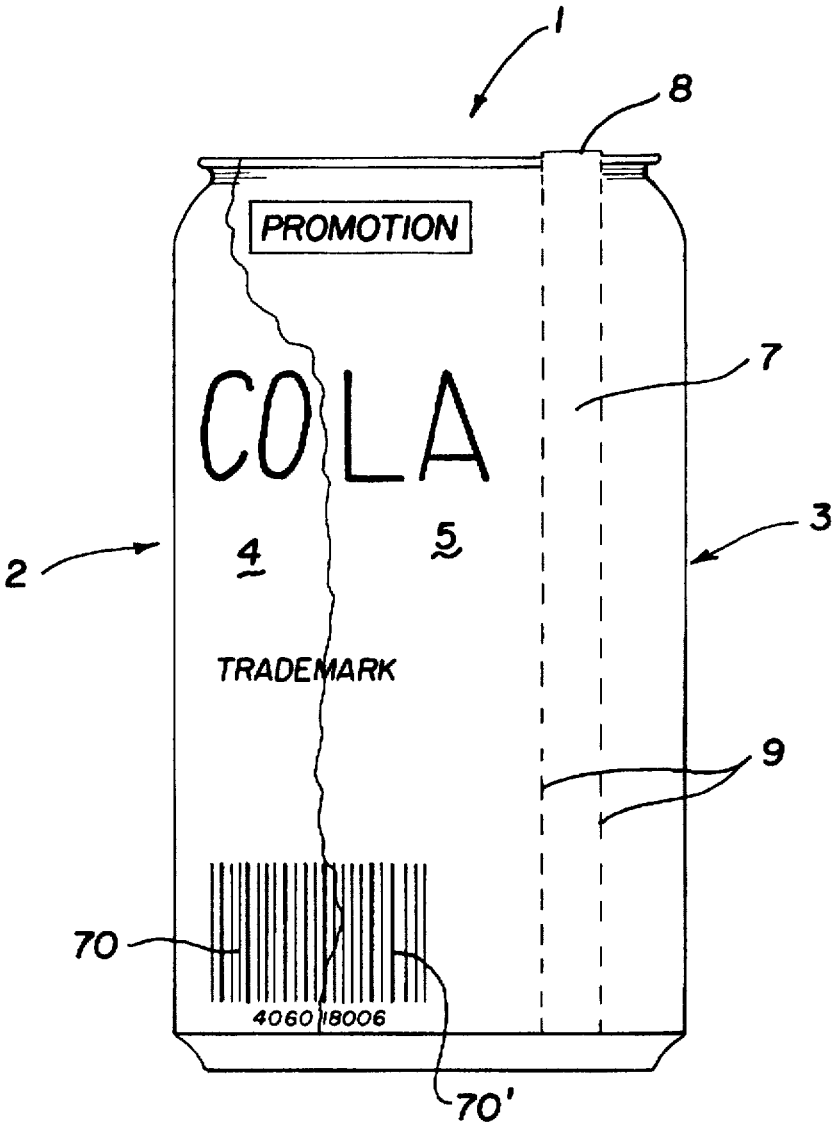
FIG. 1 illustrates an embodiment of the invention applied to a can.
Figure 2:
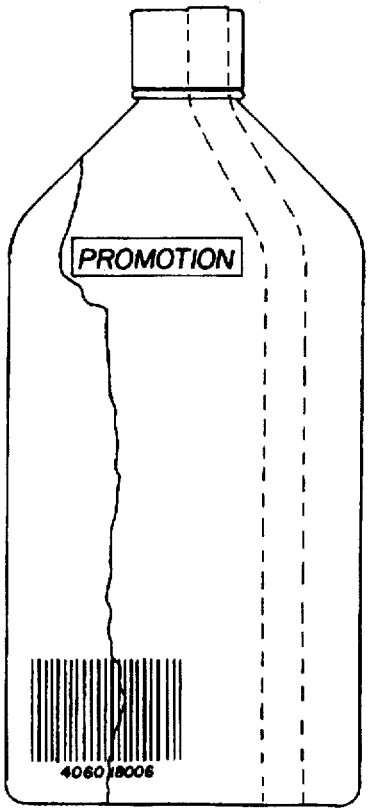
FIGS. 2 and 3 illustrate an embodiment of the invention applied to a bottle or a box.
Figure 3:
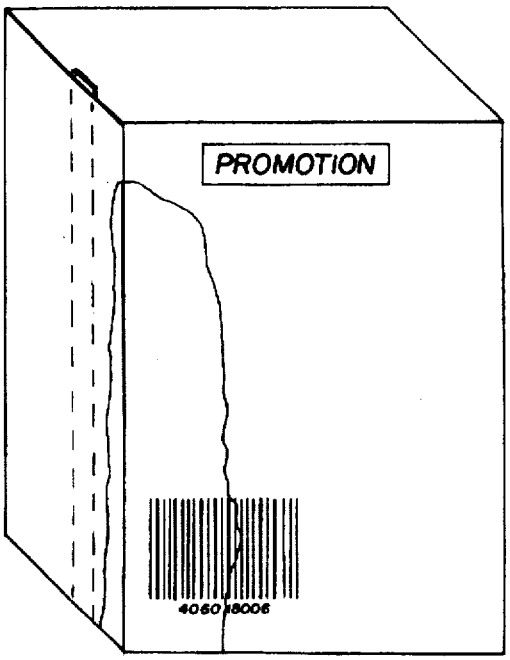

Referring now to the drawings, a retail promotional package indicated generally at 1, comprises a preformed container in the form of a regular can, indicated generally at 2, containing a carbonated drink, such as, a cola or the like. The can 2 is of the two-part type, namely, an aluminium body and an aluminium circular top (not shown) which is sealed thereto and has, say, a pull-ring associated with it for opening the can.

The outer cylindrical surface 4 of the side wall of the can 2 is printed with regular information relating to the contents of the can 2, for instance, details of the product involved, for example, the word "COLA", a trade mark indicated by the term "TRADE MARK" and a bar code 10, as well as a sell-by-date (not shown), decorative material (also not shown) and the like. In the package so far described, this is all part of the standard "get-up" of the package.

In accordance with the present invention, a wrapper indicated generally at 3, extends over substantially the whole of the outer cylindrical surface of the can 2. This wrapper 3 has been preformed from a synthetic plastics material which has been heat-shrunk on to the can 2 into intimate contact therewith, to provide a continuous and generally smooth outer surface for the package 1 which is substantially identical to the outer surface of the cylindrical side wall of the can 2.

The outer surface 5 of the wrapper 3 is printed with information which is a substantial replica of that printed on the cylindrical outer surface of the side wall of the can 2, namely, the word "COLA", a the term "TRADE MARK" and a bar code 10'. The outer wrapper surface 5 is also provided with further information relating to a short term promotion of the product, represented by the word "PROMOTION". This further information is not provided on the outer cylindrical side wall surface 4 of the can 2, and therefore does not form part of the standard "get-up" of the package, forming instead part of the special promotional "get-up" of the inventive package.

The wrapper 3 is heat shrunk on to the can 2 and the information printed on the outer wrapper surface 5 may or may not lie in substantial register with the corresponding regular information on the outer surface 4 of the can 2. In the drawing, only the letters "CO" of the word "COLA", the word "TRADE" of the term "TRADE MARK" and the left hand side of the bar code 10 can be seen, because the remaining letters "LA" of the word "COLA", the other word "MARK" of the term "TRADE MARK" and the right hand side of the bar code 10' are represented by those printed on the outer surface 5 of the wrapper 3.

The inner surface of the wrapper 3 may be provided with printed information (also not shown) relating to the short term promotion for the product, which information has been printed previously thereon and cannot be seen at point-of-sale. This information is also not part of the standard "get-up" of the package, but forms part of the special promotional "get-up" of the inventive package.

A tear strip 7 extends between the upper and lower edges of the wrapper 3, with an extension 8 protruding just above the top or bottom of the can 2 for enhancing accessibility thereto. Also, the tear strip 7 is defined by a pair of parallel perforation lines 9, in a conventional manner.

In use of the retail package 1, a purchaser thereof is able to identify the product by the information printed on the outer surface 5 of the wrapper 3, as well as being able to recognise that a short term promotion of the product is in effect by viewing the further "PROMOTION" information printed on that outer surface 5. After purchasing the product, a purchaser is able to remove the wrapper 3 attached to the can 2 by grasping the extension 8 and pulling it downwardly or upwardly with respect to the package 1, thereby removing the tear strip 7 and allowing the remainder of the wrapper 3 to be removed from the can 2. In this manner, the so-removed wrapper 3 can be used subsequently as a prize, token or voucher for redemption purposes or to relay information in connection with the promotion and any printed information relating thereto on the inner surface of the wrapper 3 can also be read by the purchaser.

As indicated above, the inner surface of the wrapper 3 may or may not be printed with further promotional information.

In a modification of the embodiment of inventive package 1 described above, the heat-shrunk wrapper may be used to secure between it and the outer surface 4 of the can 2 a carrier in the form of a strip or sheet of, say, paper, bearing additional information relevant to the promotion or the promotional prize, token or voucher itself, as an alternative or in addition to such information being printed on the inner surface of the wrapper 3 or in addition to that printed on the outer surface 5 of the wrapper 3. Once again, this provision is not part of the standard "get-up" of the package, but forms part of the special promotional "get-up" of the inventive package.

Although in the embodiments described above, the whole of the wrapper 3 is removable from the can 2, only a portion thereof may be so-removable, in which case, that removable portion may be defined by a suitably perforated line, such as, a square or circle, which can be torn from the remainder of the wrapper and which has any further information or its inner surface and/or on the outer surface 4 of the can 2.

Also, the information on the wrapper 3 which is a substantial replica of the regular information on the outer can surface 4, may be printed on the inner surface of the wrapper, in which case, the wrapper is transparent or semi-opaque, so that such information can be viewed and read from the exterior of the package 1.

Additional modifications may be made to the inventive package, for instance, means for enabling removal of the wrapper 3 other than the tear strip 7 described above and, also, the wrapper 3 may extend over only a portion of the outer surface of the can 2.

It is to be appreciated that the inventive concept may be applied to other forms of container, for instance, bottles, cups or beakers, whether made of glass or plastics or other suitable material, as well as boxes for retail display and sale.

I claim:

1. A promotional package comprising:

(a) a container having regular information extending over substantially the whole of an outer surface thereof and (b) a wrapper extending over substantially the whole of the outer container surface and bearing information of which at least some is substantially identical to at least some of the regular information on the outer container surface, wherein the information which is substantially identical to at least some of the regular information on the outer container surface and which is borne by the wrapper, extends over substantially the whole of the wrapper, whereby the appearance of the wrapper is a substantial replica of the outer container surface.

2. A promotional package according to claim 1, wherein an outer surface of the wrapper bears the information of which at least some is substantially identical to at least some of the regular information on the outer container surface.

3. A promotional package according to claim 2, wherein the outer surface of the wrapper bears further information which differs from the regular information on the outer container surface.

4. A promotional package according to claim 3, wherein at least some of the further information relates to a promotion of the product associated with the package (1).

5. A promotional package according to claim 1, wherein the wrapper is transparent.

6. A promotional package according to claim 5, wherein the inner surface of the wrapper bears further information which differs from the regular information on the outer container surface.

7. A promotional package according to claim 6, wherein at least some of the further information relates to a promotion of the product associated with the package.

8. A promotional package according to claim 1, wherein substantially all the information borne by the wrapper (3) is substantially identical to the regular information, on the outer container surface (4).

9. A promotional package according to claim 1, wherein the information borne by the wrapper(3) of which at least some is substantially identical to at least some of the regular information on the outer container surface (4), lies in register with that regular information.

10. A promotional package according to claim 1, wherein the wrapper (3) extends over the outer container surface (4) in a continuous manner, to provide a generally smooth outer surface for the package (1).

11. A promotional package according to claim 1, wherein the wrapper (3) has no overlapping portions.

12. A promotional package according to claim 1, wherein the wrapper (3) is in intimate contact with the outer container surface (4).

13. A promotional package according to claim 1, wherein additional information is included on a carrier sandwiched between the outer surface (4) of the container (2) and the wrapper (3).

14. A promotional package according to claim 13, wherein at least part of the additional information included on the carrier can be used as a prize.

15. A promotional package according to claim 13, wherein at least part of the additional information included on the carrier can be used as a token.

16. A promotional package according to claim 13, wherein at least part of the additional information included on the carrier can be used as a redeemable voucher.

17. A promotional package according to claim 1, wherein the wrapper (3) is removable from the container (2) by means of an integral tear strip (7,8).

18. A promotional package according to claim 17, wherein the tear strip (7,8) extends at least partially between opposed edges of the wrapper (3).

19. A promotional package according to claim 1, wherein the wrapper (3) is of a synthetic plastics material heat-shrunk on to the outer surface (4) of the container (2).

20. A promotional package according to claim 1, wherein the wrapper (3) is of paper.

21. A promotional package according to claim 1, wherein the wrapper (3) is adhered to the outer surface (4) of the container (2).

22. A promotional package according to claim 1, wherein at least part of the wrapper can be used as a prize.

23. A promotional package according to claim 1, wherein the outer container surface (4) on which the regular information is provided constitutes a side wall of the container (2).

24. A promotional package according to claim 1, wherein the container is a metallic can.

25. A promotional package according to claim 1, wherein the container (2) and wrapper (3) are preformed as separate components, with the wrapper (3) having been applied subsequently to the outer container surface (4).

26. A promotional package according to claim 1, wherein the inner surface of the wrapper bears the information of which at least some is substantially identical to at least some of the regular information on the outer container surface.

27. A promotional package according to claim 1, where the wrapper is semi-opaque.

28. A promotional package according to claim 1, wherein at least part of the wrapper can be used as a token.

29. A promotional package according to claim 1, wherein at least part of the wrapper can be used as a redeemable voucher.

30. A promotional package according to claim 1, wherein the container is a plastics bottle.

31. A promotional package according to claim 1, wherein the container is a glass bottle.

32. A promotional package according to claim 1, wherein the container is a box of cardboard.

* * * * *